United States Patent [19]

Irimi et al.

[11] Patent Number: 5,060,672

[45] Date of Patent: Oct. 29, 1991

[54] HIGHLY EFFICIENT TOBACCO SMOKE FILTER

[75] Inventors: Sándor Irimi; Ádám Molnár; József Gábor, all of Pécs; László Toke, Budapest; Lajos Trézl, Budapest; István Rusznák, Budapest; Viktória Horváth, Budapest; Tibor Szarvas, Budapest, all of Hungary

[73] Assignee: Pésci Dohánygyár, Pécs, Hungary

[21] Appl. No.: 447,094

[22] Filed: Dec. 6, 1989

[30] Foreign Application Priority Data

Apr. 28, 1989 [HU] Hungary ..... 202389

[51] Int. Cl.[5] ..... A24D 3/14

[52] U.S. Cl. ..... 131/331; 131/334; 131/342; 131/344; 131/345

[58] Field of Search ..... 131/331, 334, 341, 342, 131/343, 344, 345

[56] References Cited

U.S. PATENT DOCUMENTS

| | | | |
|---|---|---|---|
| 3,319,635 | 5/1967 | Stahly | 131/334 |
| 4,532,947 | 8/1985 | Caseley | 131/334 |
| 4,753,250 | 6/1988 | Bitter et al. | 131/334 |

OTHER PUBLICATIONS

"Studies on the Reactions Between Formaldehyde and Enediols", J. Am. Chem. Soc., vol. 70, pp. 898–890, 1948.

*Primary Examiner*—V. Millin

*Attorney, Agent, or Firm*—Schweitzer Cornman & Gross

[57] ABSTRACT

The invention relates to a novel, highly efficient tobacco smoke filter provided with mechanically (fibrous) and/or adsorptively filtering materials as well as chemosorptively filtering components, which comprises a synergistic composition containing at least one of a compound having a high nucleophilic additivity, capable of chemically reacting and stable adduct forming with excited and ground-level aldehydes not filtered out by the mechanically and/or adsorptively filtering materials; and at least one of a compound containing

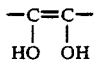

enediol structural moieties, wherein the enediol type compound or its combination suitably amount to at least 50% by weight of the other chemosorptive components and 40 to 300% by weight of the adsorptively filtering materials.

13 Claims, No Drawings

HIGHLY EFFICIENT TOBACCO SMOKE FILTER

FIELD OF THE INVENTION

This invention relates to a novel, highly efficient filter for filtering tobacco smoke containing, in addition to the known components of the usual tobacco smoke filters, particularly cigarette smoke filters, a synergistically acting substance composition which is capable of strong nucleophilic addition and makes the smoke filter useful to eliminate not only the health-damaging tar and high-boiling materials but also the highly health-damaging substances which are mechanically or adsorptively not bound, mainly to eliminate aldehydes, above all excited and ground-level carcinogenic formaldehydes, formed during the burning of tobacco in a chemosorptive way.

BACKGROUND OF THE INVENTION

Nowadays, innumerable processes used for filtering tobacco smoke are known. A great number of publications have been devoted to the additives of the smoke filters. These additives in the smoke filter are aimed to adsorb and/or absorb a certain ratio of the harmful components of cigarette smoke according to the eventual physical and/or physico-chemical relationships coming about between the constituents of the smoke filter and the components being present in the tobacco smoke.

A plethora of patented processes are particularly found under the collective noun of "substances binding and filtering out carcinogenic smoke components".

According to the published Japanese patent application No. 74/93600, the carcinogenic substance content of the tobacco smoke can be diminished by adding albumins of various types (such as lactalbumin or ovalbumin) to the smoke filter.

Various nitrogen oxides as toxic and irritating substances are found among the health-damaging materials detectable in the tobacco smoke. It has also been proven that nitrosated intermediates of nitrogen dioxide and other nitrogen oxides, such as N, N-dimethylnitrosamine, are particularly dangerous and carcinogenic to the human organism. Such substances are e.g. N'-nitroso-nornicotine or 4'-(methylnitrosamino)-1-(3-pyridyl)-1-butanone showing a high toxicity, carcinogenesis and mutagenesis [Carcinogenesis 6, 1543 (1985)]. A high number of papers have been published on the partial binding of nitrogen oxides.

In U.S. Pat. No. 3,407,820, manganese oxide and manganese dihydroxides are suggested for binding nitrogen oxides whereas the same purpose is aimed by using aluminum and zinc salts according to U.S. Pat. No. 3,875,949.

Heat-resistant resin compositions for removing by filtering the toxic tar content of the tobacco smoke are suggested in U.S. Pat. No. 3,294,095 wherein inter alia phenol-formaldehyde or urea-formaldehyde resins are used.

The research work aimed to bind cyanide compounds (HCN) in the tobacco smoke as well as to remove carbon monoxide (CO) is also described in the literature.

According to French patent No. 1,465,842, the carbonates and other salts of potassium and sodium make the smoke filter effective to bind hydrogen cyanide. According to U.S. Pat. No. 3,605,759, hydrogen cyanide is partially removed by adding polyoxyalkylene type substances to the smoke filter.

Polymeric additives are used in the smoke filter according to U.S. Pat. No. 3,311,115, which suggests zinc acetate and copper sulfate for increasing the filtration efficiency of the smoke filter. Hydrogen cyanide can effectively be bound by the said additives.

For binding carbon monoxide, the most various types of compouds, including native and macromolecular compounds, are listed in the literature. Carbon monoxide is absorbed e.g. by haemoglobin according to U.S. Pat. No. 3,982,897; whereas carbon monoxide is bound by manganese or palladium dihydroxyde as described in published Japanese patent application No. 82/136819.

A high number of literature references concern the binding of the health-damaging polycyclic aromatic compounds being present in the tobacco smoke.

According to U.S. Pat. No. 4,038,992, cellulose powder, starch and their derivatives as well as the dried concentrate of egg-white and inorganic mineral substances can effectively be used in the smoke filter as additives to filter out the polycyclic aromatic compounds being present in the tobacco smoke.

It can be stated from the literature that a high number of processes are worldwide known which suggest methods for the filtration of the tobacco smoke. It can also be stated that, in spite of the very high number of data concerning this subject, no conscious, conceptional method exists for the elimination and selective binding of the extremely harmful aldehydes, such as formaldehyde, released in the burning and being present in the tobacco smoke which, as it is commonly known, arises from a high-temperature burning.

A significant decrease in the formaldehyde content arising in the smoke on the burning of tobacco can be achieved by using the process according to the Hungarian patent No. 192,213 (equivalent to U.S. Pat. No. 4,753,250; Swiss patent No. 667,776; German (FRG) patent No. 3,532,618; or British patent No. 2,174,284), wherein the adsorptively not bound aldehydes, such as formaldehyde, are bound by enediol compounds going into a chemical reaction with the aldehydes.

According to a number of literature data, the toxic, carcinogenic, mutagenic and teratogenic effects of formaldehyde in the human organism are considered to have been proven. The above-cited Hungarian patent No. 192,213 gives an example, according to which the amount of the aldehydes arising in the smoke can be decreased by more than 50% when preferably 5 to 120%, depending on the filtration efficiency to be achieved, of an enediol type compound (e.g. reductone, dihydroxyfumaric acid, reductic acid, indanereductone, dihydroxymaleic acid, dehydro-L-ascorbic acid, L-ascorbic acid or their combinations), as calculated for one cigarette and based on the amount of the filling material, are added to activated carbon or of a mixture of activated carbon with an other granular adsorbent. A binding of 60% is described in the example.

It is suggested by this prior art that the formaldehyde being present in the smoke could be further decreased and nearly the 100% amount of formaldehyde could be eliminated by a further increase in the amount of the enediol compounds. However, the experiments carried out on the basis of this idea led to the unexpected result that the formaldehyde-binding capacity of the enediols was not significantly enhanced by a further significant increase in the amount of enediols and the highest value of the binding of formaldehyde amounted to 65%.

The aim of the present invention is to develop a filter for tobacco smoke, mainly for cigarette smoke, which is capable to bind completely or nearly completely not only the tar and other high-boiling health-damaging materials arising from the burning of tobacco but also the aldehydes being mechanically and adsorptively not bound, mainly the carcinogenic excited and ground-level formaldehydes in a chemosorptive way.

Our investigations led to the unexpected surprising result that reagents interacting with formaldehyde at a well-known high rate could not surpass the extent (65%) of binding formaldehyde described in Hungarian patent No. 192,213. These compounds were e.g. dimedone (5,5-dimethylcyclohexane-1,3-dione), a substance used for the analytical determination of formaldehyde [Spencer et al.: "The Kinetics and Mechanism of the Reaction of Formaldehyde with Dimedone", J. Am. Chem. Soc. 70, 1943 (1948)], as well as other commonly known compounds reacting at a high rate with formaldehyde in an addition reaction such as D, L-homocysteine, D,L-arginine, D,L-lysine as well as streptomycin consisting of streptose and streptidine bearing two guanidine groups (similarly to L-arginine) with a high reactivity toward formaldehyde.

An other compound, thiamine hydrochloride (vitamin $B_1$) also contains an amino group with a high reactivity toward formaldehyde (similarly to L-lysine). The endoguanidine group of folic acid is also capable of reacting with formaldehyde at a high rate.

In spite of these facts, the highest value of 65% formaldehyde binding achieved by using the process described in the Hungarian patent specification No. 192,213 could not be surpassed by using the compounds listed hereinbefore in the filter.

Our systematic studies have shown that neither the compounds in themselves, which are similar to the enediols and possess a high nucleophilic additivity, nor their double, triple or quadruple systems in combinations were suitable to bind completely the 100% amount of formaldehyde being present in the smoke.

DESCRIPTION OF THE INVENTION

This led to the recognition according to the invention that a significant technical progress in the formaldehyde-binding capacity can be achieved by using a synergistic composition one component of which contains, suitably at least 50% by weight of enediol compounds possessing a high nucleophilic additivity. The technical advance appears therein that, due to the mutual strengthening of the effect of each other, the synergistic components are capable to bind and remove nearly 100% of the formaldehyde being present in the tobacco smoke.

It is commonly known that tobacco smoke is the result of a high-temperature burning. A number of compounds of various kinds are liberated in the course of the burning such as the above-mentioned carcinogenic aldehydes, nitrosamines, benzpyrenes and the like. In addition to these, a particular group of the burning product is represented by the free radical compounds which have a longer or shorter life span. Particularly dangerous are the free radicals with a long life span which can reach the human organism and start dangerous reactions there. These free radicals are extremely carcinogenic [M. J. Lyons: Free-Radicals Produced in Cigarette Smoke, Nature 181, 1003 (1958); A. L. Blohm et al.: Free Radicals in Tobacco Smoke, Nature 229, 500 (1971).]

Peroxides, hydroperoxide, hydroxyl radicals, various types of oxygen radicals and high-energy singlet oxygen are present among the free radicals. These active oxygens are also dangerous to the human organism since, after entering the human organism, they attack the enzyme system, particularly the sulfur-containing methionine segments in the proteins, and oxidize the methionine to its sulfoxide whereby the activity of the enzyme gets lost [Shun-Kai-Chan: "$\gamma_1$-Protease Inhibitor Inactivated by Smoking", Science 224, 775 (1984)]. It has experimentally been proved that methionine as an amino acid can be also a good scavenger of the reactive single oxygen being present in the smoke.

Peroxides are capable to significantly excite the formaldehyde whereby radical formaldehyde is formed (with chemiluminescence) which can immediately go into a methylation or formylation reaction with lysine [Trézl et al.: "Formation of Excited Formaldehyde in Model Reactions Simulating Real Biological Systems", J. Mol. Structures 170, 213 (1988)].

The orange-coloured chemiluminescence was observed also by other authors when formaldehyde was oxidized by using hydrogen peroxide in the presence of pyrogallol [H. H. Wassermann and R. W. Murray: Singlet Oxygen, Academic Press, New York (1977), page 110]. In his comprehensive book, Semjonov deals in detail with the properties of aldehydes arising from the interactions of radical peroxides and hydroperoxides formed in the high-temperature burning of organic compounds [N. N. Semjonov: "Some Problems of Chemical Kinetics and Reactivity (Free Radicals and Chain Reactions)" (in Hungarian), Akadémiai Kiadó, Budapest (1961)].

It can be stated as a result of these investigations that a significant release of formaldehyde is always the result of radical mechanisms.

Thus, based on literature considerations and own model experiments, it could be expected (and was extensively proved by our examinations) that aldehydes released in the tobacco smoke during the burning such as the most dangerous formaldehyde arise not only in the ground-level but also in an excited (radical) state and simultaneously other radical compounds together with peroxides and singlet oxygen, are also present. For binding the excited formaldehyde of this type, such compounds should be incorporated into the smoke filter which are capable of directly reacting with the radical formaldehyde at a high rate. According to our investigations, suitable compounds of this type are e.g. S-methyl-cysteine, N-acetylcysteine, D,L-homocysteine, L-methionine, D,L-cysteine, D,L-lysine, N-methyllysine, D,L-arginine, D,L-ornithine, glycine, formylglycine and N-methylglycine (sarcosine),selenocysteine, glutathione, dimedone, and urea; 4,5-dihydroxyethyleneurea, N-hydroxyurea and aminoacetonitrile are particularly suitable ones.

It has been proved by our examinations that, after adding tritiated L-lysine (6-$^3$H-L-lysine) to an aqueous solution of the tobacco smoke condensate, N-methylated and N-formylated lysines (6-$^3$H-N-methyl-L-lysine and 6-$^3$H-N-formyl-L-lysine) could immediately be detected by isotope analysis. Thus, it has been proved that the excited formaldehyde being present in the smoke condensate gave the same reaction with L-lysine as in the model reaction when excited formaldehyde was separately added to a solution of L-lysine. However, when the radical scavengers, i.e. scavengers of the radical formaldehyde, were incorporated into the smoke filter, then after absorption of the smoke condensate and addition of 6-$^3$H-L-lysine, no or nearly no tritiated methyl- or formyl-L-lysine arose which fact was excellently proven by isotope analysis.

Summing up, it can be stated that the synergistic compositions should be developed in such a way that certain components, including the enediols, go into a strong nucleophilic addition with the non-excited (ground-level) formaldehyde molecules whereas other components eliminate the excited radical formaldehyde from the tobacco smoke.

Due to its partial positive charge, the strongly electrophilic carbon atom of the carbonyl group of formaldehyde is prone to nucleophilic addition. Thus, nucleophilic reagents (nitrogen and sulfur compounds containing a lone electron pair, —$NH_2$, —SH groups) are capable to attack this carbon atom and to react with it.

It is obvious that not only formaldehyde radicals but also other radicals such as peroxide radicals and singlet oxygen can also be eliminated by the scavanger compound.

This has also been proved by experiments; namely, when the tobacco smoke condensate was introduced into a solution of lysine, the chemiluminescence could be determined by a Packard liquid scintillation measuring device. However, when scavengers were incorporated to the filter, the phenomenon of the singlet oxygen release was decreased or could not be observed. Thus, in addition to the excited formaldehyde, singlet oxygen was also eliminated to a significant extent.

In the highly efficient tobacco smoke filter according to the invention, which is provided with mechanically e.g. fibrous granular and/or adsorptively filtering materials as well as chemosorptively filtering components, the latter contains a synergistic composition comprising at least one of a compound having a high nucleophilic additivity, capable of chemically reacting and stable adduct forming with excited and ground-level aldehydes not filtered out by the mechanically and/or adsorptively filtering materials; and at least one of a compound containing

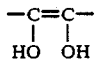

enediol structural moieties, wherein the enediol type compounds or its combinations suitably amount to at least 50% by weight of the other chemosorptive components and 40 to 300% by weight of the adsorptively filtering materials.

The embodiments of the tobacco smoke filter according to the invention are illustrated in detail in the following non-limiting Examples.

EXAMPLE 1

A synergistic composition comprising compounds having a high nucleophilic additivity and reacting with the adsorptively not bound excited and ground-level aldehydes at a high rate, increasing with the temperature (whereby the desorption of the aldehydes is excluded), i.e. a combination of D,L-homocysteine (77% by weight)+urea (13% by weight)+citric acid (10% by weight) or dimedone (47% by weight)+lysine (32% by weight)+methionine (21% by weight), or D,L-cysteine (83% by weight)+urea (7% by weight)+citric acid (10% by weight), or D,L-cysteine (84% by weight)+citric acid (16% by weight), or glycine (35% by weight)+histidine (45% by weight)+glutathione (10% by weight)+tartaric acid (10% by weight), or D,L-cysteine (63% by weight)+dimedone (7% by weight)+urea (10% by weight)+citric acid (20% by weight), or N-hydroxyurea (biosuppressine) (66% by weight)+D,L-arginine (20% by weight)+oxidized glutathione (10% by weight)+malic acid (4% by weight), or selenocysteine (34% by weight)+D,L-lysine (26% by weight)+4,5-dihydroxyethyleneurea (34% by weight)+$MnCl_2.4H_2O$ (6% by weight)

and compound(s) containing the

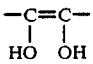

enediol structure moiety, i.e. L-ascorbic acid or dihydroxyfumaric acid, wherein the enediol type compound or its combinations amount to 50% by weight in relation to all other nucleophilic components and/or radical scavengers, mainly radical aldehyde-scavenging components ensuring the chemosorptive effect, is added to activated carbon or to a mixture of activated carbon with an other granular adsorbent. The above synergistic composition is preferably added in the following amounts to the activated carbon or to a mixture of activated carbon and an other granular adsorbent, depending on the weight thereof and on the filtration efficiency to be achieved.

| Activated carbon or a mixture thereof (mg) | Synergistic composition of the invention (mg) |
|---|---|
| 10 | 12 |
| 20 | 26 |
| 30 | 46 |
| 40 | 54 |
| 50 | 68 |
| 60 | 82 |

The adsorbent and the synergistic composition are thoroughly mixed, homogenized and introduced into the fibrous base filter.

EXAMPLE 2

A homogenized mixture of hydrophobic filter perlite with any of the synergistic compositions according to Example 1 is applied onto paper or cellulose acetate carrier in the following ratio calculated for one cigarette.

| Filter perlite mg | Synergistic compositions of the invention mg |
|---|---|
| 5 | 20 |
| 10 | 30 |
| 20 | 40 |
| 30 | 50 |
| 40 | 65 |
| 50 | 90 |

EXAMPLE 3

An aqueous solution, suitably a 5 to 25% by weight solution of any of the synergistic compositions described in Example 1 is applied onto a filter paper, preferably in an amount of 10 to 100 mg. of dry substance calculated for one cigarette. Then, the filter is dried and transformed to a rod.

EXAMPLE 4

Any of the synergistic compositions described in Example 1 in a powdered or granulated form is applied onto a paper or cellulose acetate base fibrous material in an uniform distribution, preferably in an amount of 10 to 100 mg. calculated for one cigarette. Crinkled paper or cellulose web can also be used as fibrous material.

EXAMPLE 5

Any of the synergistic compositions described in Example 1 or a mixture of these compositions with activated carbon, filter perlite or with a mixture of the latter ones are incorporated to a space of 3 to 5 mm in width between two filter elements in an amount defined in the Examples 1 to 4.

EXAMPLE 6

As catalyst increasing the efficiency of the synergistic compositions, suitably 5 to 30% by weight (calculated for the amount of the synergistic composition used) of $CuSO_4.5H_2O$ or $MnCl_2.4H_2O$ or $ZnCl_2.4H_2O$, finely powdered and homogenized with the synergistic composition and the granular adsorbents, are added to a mixture described in Examples 1 to 5.

EXAMPLE 7

By mixing any of the synergistic compositions with a low-melting substance and solidifying the mixture, a porous cylindrical smoke filter element is obtained which is then used for preparing the smoke filter.

EXAMPLE 8

Any of the synergistic compositions is used together with each other or with other enediol compounds in the processes described in Examples 1 to 7.

EXAMPLE 9

Fibrous (paper, cellulose acetate, viscose base) filter material is impregnated with a 5 to 25% by weight aqueous solution of any of the synergistic compositions according to Example 1 in such a way that 10 to 100 mg. of a synergistic composition, preferably at least 50% by weight of ascorbic acid as an enediol compound, 25% by weight of a compound with high nucleophilic additivity and 25% by weight of a radical scavenger compound fall to one cigarette.

EXAMPLE 10

10 to 100 mg. (calculated for one cigarette) of a synergistic composition reacting with the excited and ground-level aldehydes, suitably comprising at least 50% by weight of L-ascorbic acid as enediol type compound, 25% by weight of a compound with high nucleophilic additivity and 25% by weight of a radical scavenger compound, are added to a porous granular adsorbent, preferably to activated carbon or filter perlite, then the homogenized mixture thereof is placed between two fibrous filter elements.

We claim:

1. A tobacco smoke filter, which comprises a (i) mechanically, adsorptively, or both mechanically and adsorptively filtering component, and a (ii) chemosorptively filtering component, wherein (ii) is a synergistic composition which comprises (a) at least one compound which contains a

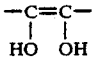

enediol structural moiety, and (b) at least one compound adapted to undergo a rapid nucleophilic addition reaction with excited and ground level aldehydes not filtered out by (i).

2. The tobacco smoke filter of claim 1, wherein (a) comprises at least 50% (wt) of (ii), and from 40% to 300% (wt) of (i).

3. The tobacco smoke filter of claim 1, wherein (i) is hydrophobic perlite, activated carbon, or a porous silicate, and (b) comprises (I) at least one radical scavenger of aldehydes, and (II) at least one compound having high nucleophylic additivity to formaldehyde.

4. The tobacco smoke filter of claim 3, wherein the aldehyde is formaldehyde, (I) is at least one of reduced or oxidized glutathione, urea, and a urea derivative, (II) is at least one of D,L-lysine, glycine, D,L-cysteine, D,L-cystine, D,L-arginine, thioglycolic acid, dimedone, and homocysteine, and (a) is at least one of dihydroxyfumaric acid, and L-ascorbic acid.

5. The tobacco smoke filter of claim 1, wherein the smoke to be filtered is cigarette smoke, (i) is a powdered, fibrous, or granular material, and 10 to 100 mg of (ii) is contained in the smoke filter of each cigarette.

6. The tobacco smoke filter of claim 5, wherein (i) is cellulose acetate, crepe paper, or viscose pall.

7. The tobacco smoke filter of claim 5, wherein (i) is impregnated with a solution containing 10 to 100 mg (dry basis) of (ii).

8. The tobacco smoke filter of claim 7, wherein said solution is a from 5 to 25% (wt) aqueous solution.

9. The tobacco smoke filter of claim 1, wherein (i) comprises a powdered or granular material disposed between two fibrous filter elements.

10. The tobacco smoke filter of claim 1, further comprising from 5% to 30% (wt) based on (ii) of a catalyst adapted to react with the aldehyde in the smoke.

11. The tobacco smoke filter of claim 10, wherein said catalyst is a metal salt.

12. The tobacco smoke filter of claim 11, wherein said metal salt is one or more of $MnCl_2.4H_2O$, $CuSO_45H_2O$, and $ZnCl_2.4H_2O$.

13. The tobacco smoke filter of claim 1, wherein (b) comprises a combination of:

D,L-homocysteine + urea + citric acid;
dimedone + lysine + methionine;
D,L-cysteine + urea + citric acid;
D,L-cysteine + citric acid;
glycine, + histidine + glutathione + tartaric acid;
D,L-cysteine + dimedone + urea + citric acid;
N-hydroxyurea(biosuppressine) + D,L-arginine + oxidized glutathione + malic acid, or
selenocysteine + D,L-lysine + 4,5-dihydroxyethyleneurea + $MnCl_2.4H_2O$, and (a) comprises at least 50% (wt) based on (ii).

* * * * *